US006536416B1

(12) United States Patent
Mahr et al.

(10) Patent No.: US 6,536,416 B1
(45) Date of Patent: Mar. 25, 2003

(54) FUEL INJECTION METHOD AND SYSTEM FOR AN INTERNAL COMBUSTION ENGINE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 137 days.

(21) Appl. No.: 09/641,510

(22) Filed: Aug. 21, 2000

(30) Foreign Application Priority Data

Aug. 20, 1999 (DE) ..... 199 39 420

(51) Int. Cl.[7] ..... F02M 37/04
(52) U.S. Cl. ..... 123/506; 123/447; 123/496
(58) Field of Search ..... 123/299, 300, 123/446, 456, 447, 496, 506; 239/88–96

(56) References Cited

U.S. PATENT DOCUMENTS 5,711,274 A * 1/1998 Drummer ..... 123/456
5,771,865 A * 6/1998 Ishida ..... 123/467
6,067,964 A * 5/2000 Ruoff et al. ..... 123/467
6,112,721 A * 9/2000 Kouketsu et al. ..... 123/447
6,336,444 B1 * 1/2002 Suder ..... 123/496

FOREIGN PATENT DOCUMENTS

DE 196 12 737 A1 10/1996
DE 695 05 741 T2 7/1999
DE 696 05 075 T2 6/2000

* cited by examiner

*Primary Examiner*—Carl S. Miller
(74) *Attorney, Agent, or Firm*—Ronald E. Greigg

(57) ABSTRACT

A method and system for injecting fuel in at least two different high fuel pressures via injectors into a combustion chamber of an internal combustion engine. The higher fuel pressure being stored in a central pressure reservoir, the lower fuel pressure is generated individually locally for each injector, at all times during the injection event by diversion of the higher fuel pressure. The diversion being activatable or deactivatable via a multi-way valve. To that end, a corresponding fuel injection system with a central pressure reservoir for storing the higher fuel pressure has a local diversion unit for each injector by means of which the lower fuel pressure can be generated dissipatively from the higher fuel pressure, and the local diversion unit has a multi-way valve for activating and deactivating the diversion, respectively. In this way, an improved metering of the lower fuel pressure can be achieved.

19 Claims, 5 Drawing Sheets

FUEL INJECTION METHOD AND SYSTEM FOR AN INTERNAL COMBUSTION ENGINE

BACKGROUND OF THE INVENTION

The invention is based on a fuel injection method for an internal combustion engine and to a fuel injection system as generically defined by hereinafter.

One such injection system has been disclosed by European Patent Disclosure EP 0 711 914 A1, for instance.

For the sake of better comprehension of the ensuing description, several terms will first be defined further: In a pressure-controlled fuel injection system, by means of the fuel pressure prevailing in the nozzle chamber of an injector, a valve body (such as a nozzle needle) is opened counter to the action of a closing force, and the injection opening is thus opened for an injection of the fuel. The pressure at which fuel emerges from the nozzle chamber into the cylinder is called the injection pressure. Within the scope of the invention, the term stroke-controlled fuel injection system is understood to mean that the opening and closure of the injection opening of an injector are accomplished with the aid of a displaceable valve member on the basis of the hydraulic cooperation of the fuel pressures in a nozzle chamber and in a control chamber. Furthermore, an arrangement will hereinafter be called central if it is intended for all the cylinders in common, and local if it is intended for only a single cylinder.

In the pressure-controlled fuel injection system known from EP 0 711 914 A1, with the aid of a high-pressure pump, fuel is compressed to a first, high fuel pressure of approximately 1200 bar and stored in a first pressure reservoir. The fuel at high pressure is also fed into a second pressure reservoir, in which a second high fuel pressure of about 400 bar is maintained by regulating the fuel delivery to the second pressure reservoir by means of a 2/2-way valve. Via a central valve control unit and a central distributor device, either the lower or the higher fuel pressure is introduced into the nozzle chamber of an injector. There, a spring-loaded valve body is lifted from its valve seat by the pressure, so that fuel can emerge from the nozzle opening.

In this known injection system, the lower fuel pressure cannot be metered optimally, for instance for the preinjection, because of line losses along the relatively long lead lines to the injectors.

From International Patent Disclosure WO98/09068, a stroke-controlled injection system is also known, in which again two pressure reservoirs for storing the two fuel pressures are provided. Once again, the metering of the applicable fuel pressure is effected via central valve units.

OBJECT AND SUMMARY OF THE INVENTION

To attain improved metering of the lower fuel pressure, the injection method of the invention has definitive characteristics, and the injection system of the invention has the definitive characteristics set forth herein. Refinements according to the invention are recited hereinafter.

According to the invention, it is proposed that the lower fuel pressure be generated not centrally but rather locally for each injector, dissipatively via a diversion unit. Because of the short line between the local diversion unit and the nozzle chamber of the injector, line losses are reduced to a minimum. Because of the local generation of the lower pressure, no second pressure reservoir is needed. Further advantages are the good replicability of the preinjection and postinjection with the lower fuel pressure, as well as a reduced influence on the preinjection and postinjection of component tolerances.

Further advantages and advantageous refinements of the subject of the invention can be learned from the description, drawings and claims.

Various exemplary embodiments of fuel injection systems of the invention, in which the lower fuel pressure for each injector is generated individually and dissipatively, are shown schematically in the drawings and described in detail in the ensuing description.

The invention will be better understood and further objects and advantages thereof will become more apparent from the ensuing detailed description of preferred embodiments taken in conjunction with the drawing.

DESCRIPTION OF THE PREFERRED EMBODIMENTS

Figure 1A:
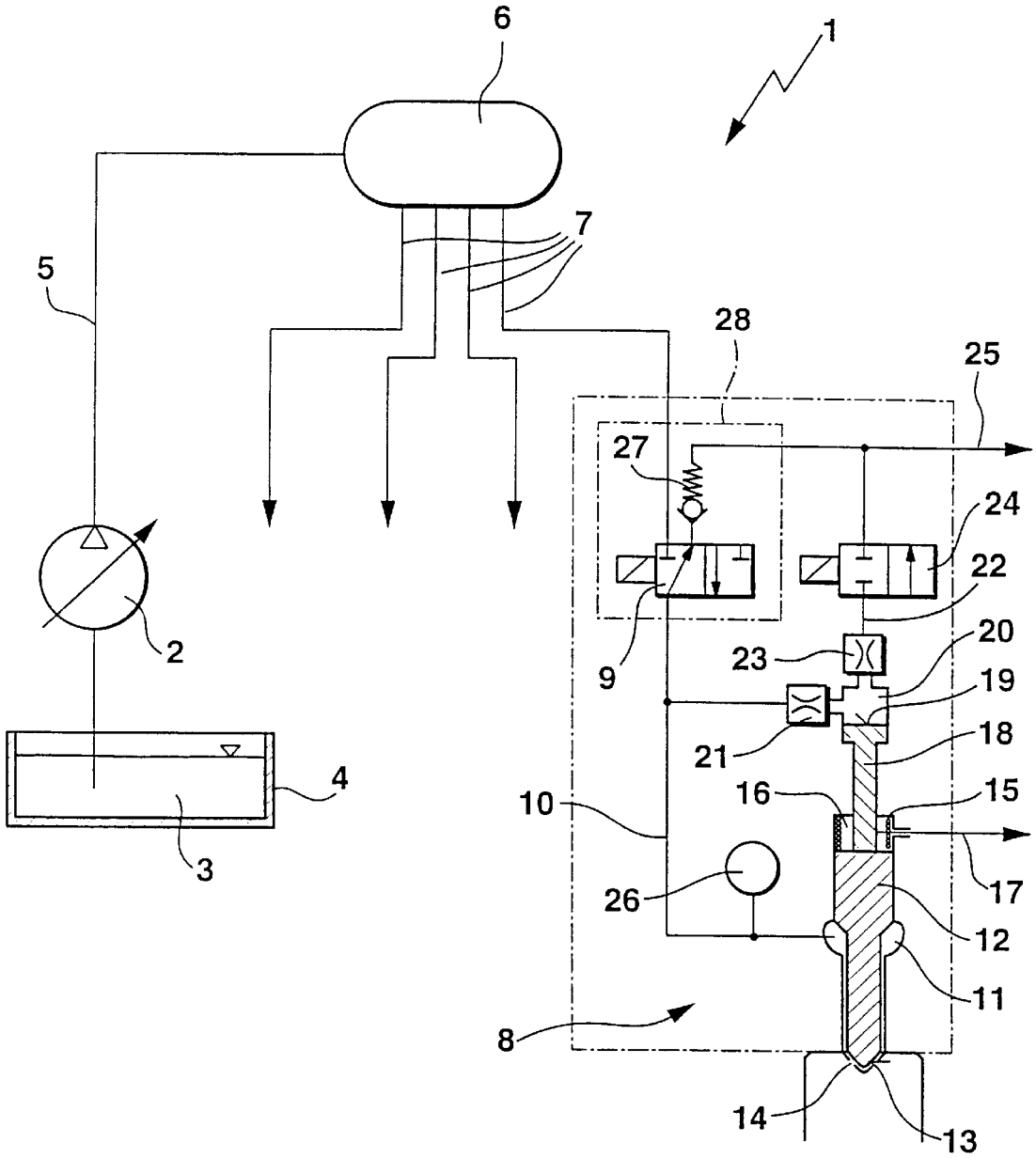
FIGS. 1*a* and 1*b* show different modifications of a first stroke-controlled fuel injection system for an injection with two different high fuel pressures, with one local diversion unit and one local accumulator chamber for each injector.
Figure 1B:
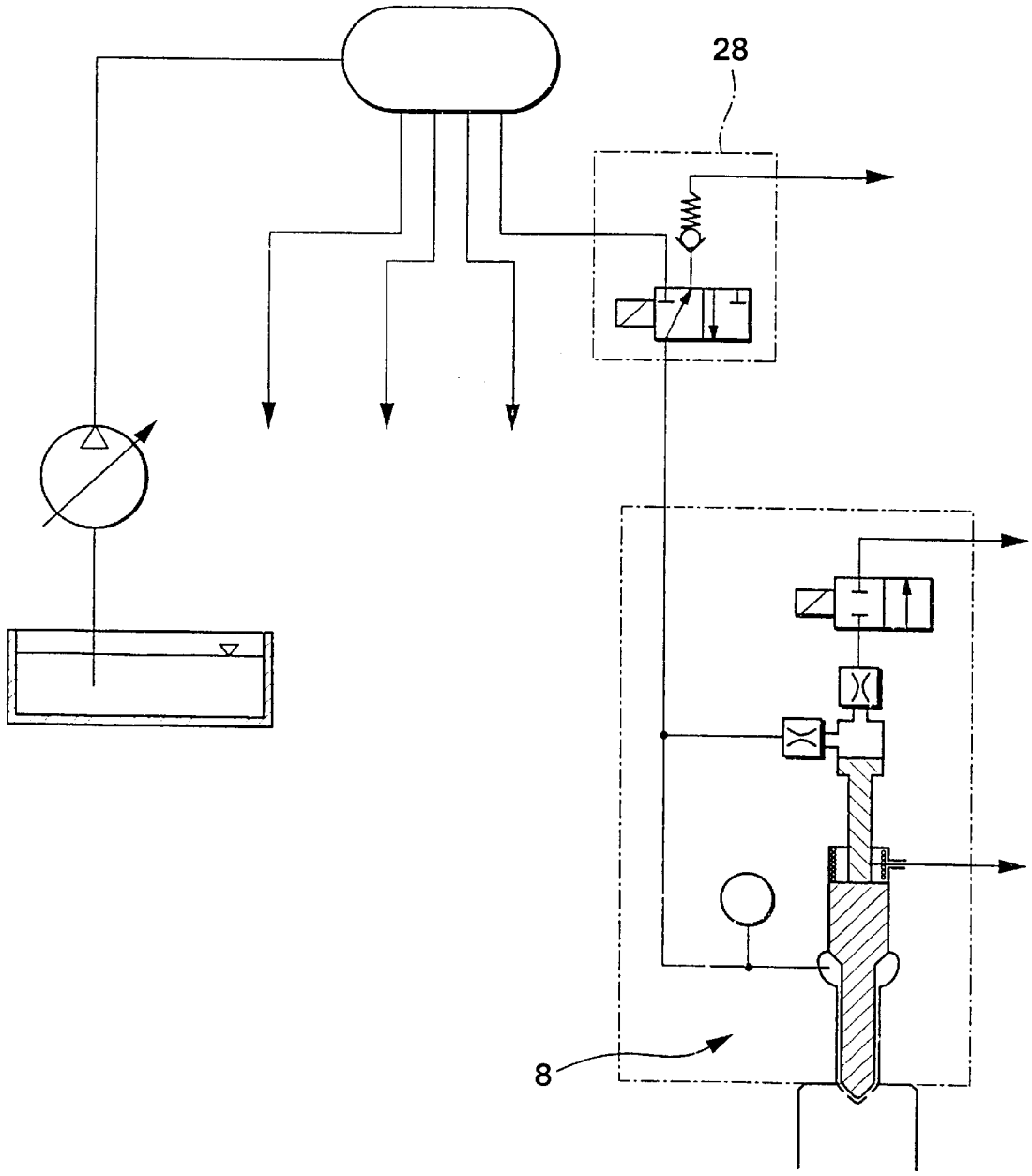

In the first exemplary embodiment of a stroke-controlled fuel injection system 1 shown in FIGS. 1*a* and 1*b,* a quantity-regulated high-pressure pump 2 pumps fuel 3 from a tank 4 at high pressure via a feed line 5 into a central pressure reservoir 6 (high-pressure common rail), from which a plurality of high-pressure lines 7, corresponding in number to the number of cylinders, lead to the individual injectors 8 (injection devices) that protrude into the combustion chamber of the internal combustion engine to be supplied. In FIG. 1*a,* only one of the injectors 8 is shown in detail. A first, higher fuel pressure of approximately 300 bar to 1800 bar can be stored in the pressure reservoir 6.

The higher fuel pressure present in the high-pressure line 7 is carried, by means of supplying electric current to a 3/2-way valve 9, via a pressure line 10 into a nozzle chamber 11 of the injector 8. The injection at the higher fuel pressure (main injection) is effected with the aid of a spool-like valve member 12 (nozzle needle) which is axially displaceable in a guide bore and whose conical valve sealing face 13 cooperates with a valve seat face on the injector housing and thus closes the injection openings 14 provided there. Inside the nozzle chamber 11, a pressure face of the valve member 12 pointing in the opening direction of the valve member 12 is exposed to the pressure prevailing; via an annular gap between the valve member 12 and the guide bore, the nozzle chamber 11 continues as far as the valve sealing face 13 of the injector 8. By the pressure prevailing in the nozzle chamber 11, the valve member 12 sealing off the injection openings 14 is opened, counter to the action of a closing force (closing spring 15), and the spring chamber 16 is pressure-relieved by means of a leakage line 17. A pressure piece 18 engages the valve member 12 coaxially to the closing spring 15 and with its face end 19 remote from the valve sealing face 13, the pressure piece defines a control chamber 20. The control chamber 20 has a fuel inlet, from the pressure line 10, that has a first throttle 21 and a fuel outlet to a pressure relief line 22 with a second throttle 23, which by means of a control device in the form of a 2/2-way valve 24 can be made to communicate with a leakage line 25. The pressure piece 18 is urged by pressure in the closing direction via the pressure in the control chamber 20. By actuating (supplying electric current to) the 2/2-way valve 24, the pressure in the control chamber 20 can be reduced, so that as a consequence, the pressure in the nozzle chamber 11 acting on the valve member 12 in the opening direction exceeds the pressure acting on the valve member 12 in the closing direction. The valve sealing face 13 lifts away from the valve seat face, so that an injection at the fuel pressure takes place. The process of relieving the control chamber 20 and thus controlling the stroke of the valve member 12 can be varied by way of the dimensioning of the two throttles 21, 23. The injection is then terminated by closure of the 2/2-way valve 24.

This injection at the higher fuel pressure (main injection) is effected, with current being supplied to the 3/2-way valve 9, in stroke-controlled fashion via the 2/2-way valve 24. During the main injection, an accumulator chamber 26, connected to the pressure line 10 near the nozzle chamber 11, is filled with fuel that is at the higher fuel pressure. By switching the 3/2-way valve 9 back into the state without electric current, the main injection is terminated, and the pressure line 10 is made to communicate with the leakage line 24 via a pressure limiting valve 27 that is adjusted to a second, lower fuel pressure (approximately 300 bar). The leakage line 25 serves the purpose of pressure relief and can lead back into the tank 4. Because of the switchover, the higher fuel pressure that initially still prevails in the pressure line 10, the accumulator chamber 26, and the nozzle chamber 11, decreases to the lower fuel pressure. This lower fuel pressure serves the purpose of preinjection and/or postinjection (HC enrichment for the sake of post-treatment of the exhaust gas).

The injection at the lower fuel pressure stored in the accumulator chamber 26 is effected, with no current being supplied to the 3/2-way valve 9, in stroke-controlled fashion via the 2/2-way valve 24 and can take place either after the main injection in the form of a postinjection or before the main injection in the form of a preinjection. If even after a postinjection the accumulator chamber 26 is still adequately filled with fuel under pressure, then this fuel can be used in the next injection cycle for a preinjection. The size of the accumulator chamber 26 is adapted to the requirements of the preinjection and post injection, and the function of the accumulator chamber 26 can also be performed by a pressure line, if it is made large enough.

The local diversion unit, identified overall by reference numeral 28 in FIG. 1 and comprising the 3/2-way valve 9 and the pressure limiting valve 27, can be disposed either inside the injector housing (FIG. 1*a*) or outside it (FIG. 1*b*).

In the ensuing description of the other drawing figures, only the differences from the fuel injection system of FIG. 1 will be addressed. Identical or functionally identical components are identified by the same reference numerals and will not be described in further detail.

Figure 2:
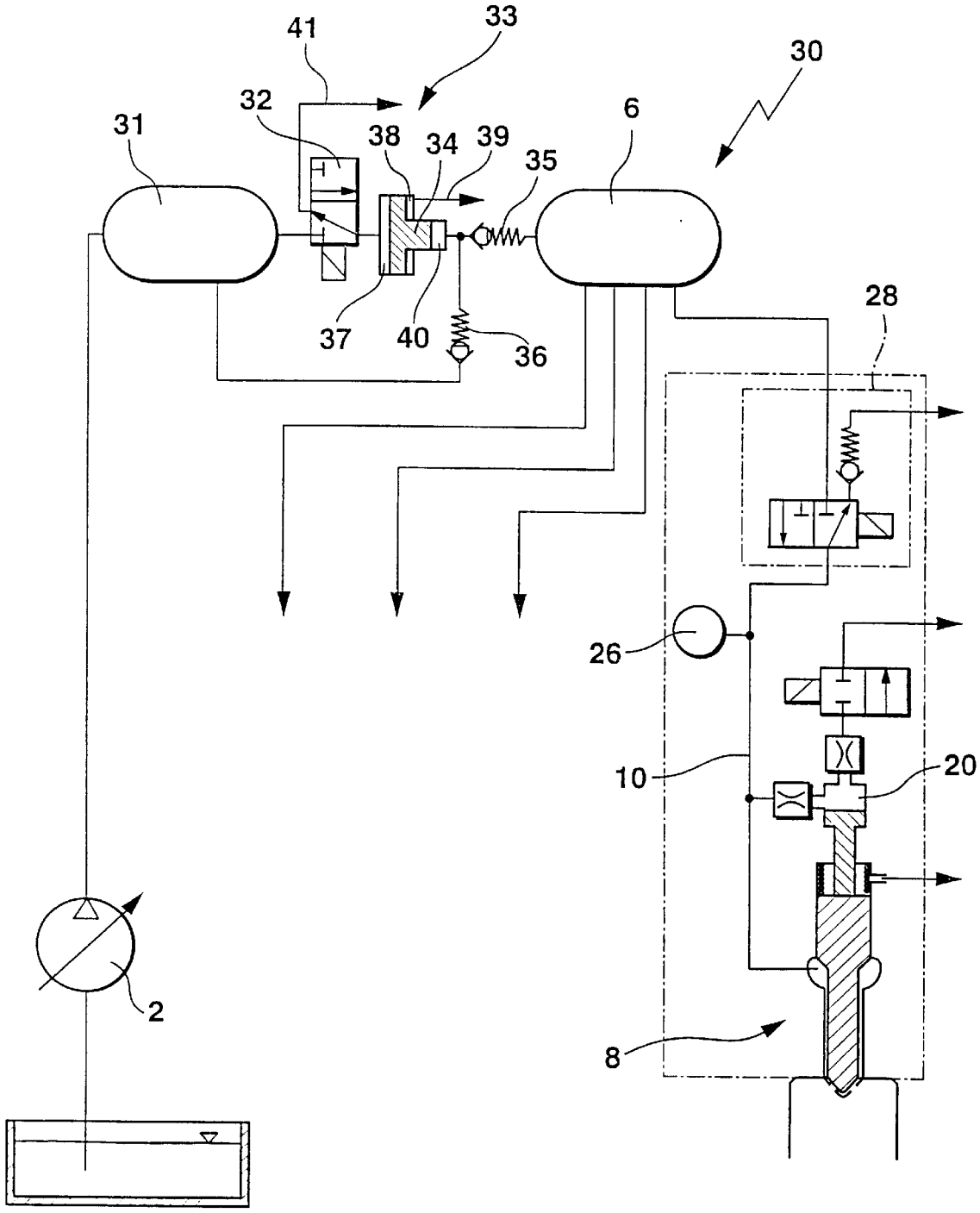
FIG. 2 shows a second stroke-controlled fuel injection system with a pressure generation of the higher fuel pressure that is modified compared with FIGS. 1*a* and 1*b;*

The injection system 30 shown in FIG. 2 corresponds to the injection system 1, with the exception of how the higher fuel pressure is generated. The high-pressure pump 2 pumps fuel into a first central pressure reservoir 31 (low-pressure common rail). The fuel, stored there at a pressure of approximately 300 to 1000 bar, is compressed to the higher fuel pressure (approximately 600 to approximately 2000 bar) by means of a central pressure step-up unit and stored in the second central pressure reservoir 6. The pressure step-up unit includes a valve unit 32 for triggering the pressure step-up, a pressure step-up means 33 with a pressure means 34 in the form of a displaceable spool element, and two check valves 35 and 36. The pressure means can be connected at one end, with the aid of the valve unit 32, to the first pressure reservoir 31, so that it is acted upon by pressure on one end by the fuel located in a primary chamber 37. A differential chamber 38 is pressure-relieved by means of a leakage line 39, so that the pressure means 34 can be displaced in the compression direction in order to reduce the volume of a pressure chamber 40. As a result, the fuel located in the pressure chamber 40 is compressed to the higher fuel pressure in accordance with the ratio between the areas of the primary chamber 37 and the pressure chamber 40 and is delivered to the second pressure reservoir 6. The check valve 35 prevents the return flow of compressed fuel out of the second pressure reservoir 6. If the primary chamber 37 is connected with the aid of the valve unit 32 to a leakage line 41, then the restoration of the pressure means 34 and the refilling of the pressure chamber 40 take place, the pressure chamber being connected to the first pressure reservoir 61 via the check valve 36. Because of the pressure ratios in the primary chamber 37 and the pressure chamber 40, the check valve 36 opens, so that the pressure chamber 40 is subject to the fuel pressure of the first pressure reservoir 31, and the pressure means 34 is returned hydraulically to its outset position. To improve the restoration performance, one or more springs can be disposed in the chambers 37, 38 and 40. In the exemplary embodiment shown, the accumulator chamber 26 is disposed in the pressure line 10 between the local diversion unit 28 and the inlet to the control chamber 20, and the valve unit 32 is shown purely as an example as a 3/2-way valve.

Figure 3:
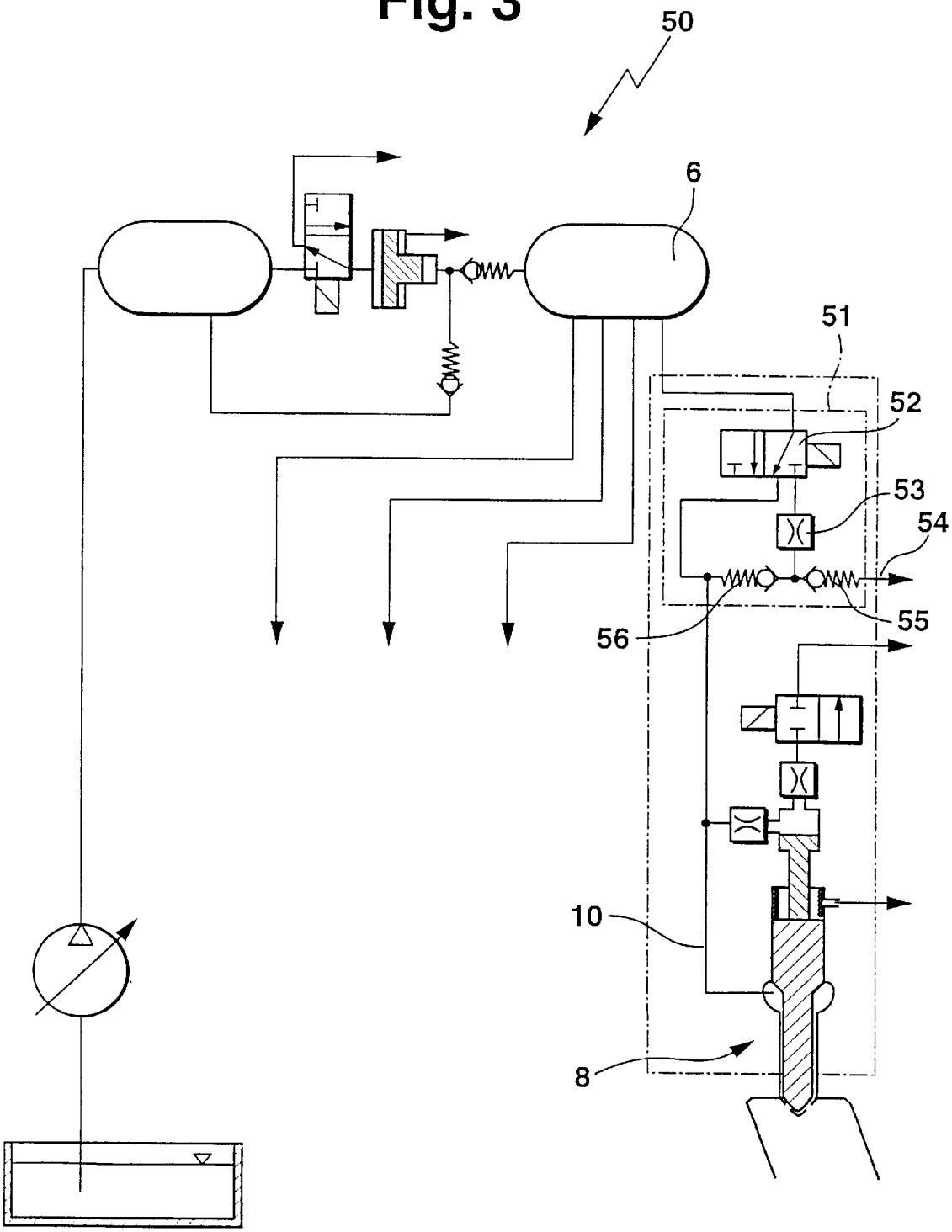
FIG. 3 shows a third stroke-controlled fuel injection system without a local accumulator chamber, but with one local diversion unit, modified over FIGS. 1*a* and 1*b,* for each injector.

Unlike the injection system 30, the injection system 50 of FIG. 3 has a modified local diversion unit 51 and has no accumulator chamber. The diversion unit 51 includes a 3/2-way valve 52, so that the higher fuel pressure stored in the second pressure reservoir 6 can either be switched through or diverted dissipatively by means of a throttle 53 and a pressure limiting valve 55 that is set to the lower fuel pressure and communicates with a leakage line 54. Whatever pressure prevails at the pressure limiting valve is then carried on, as in FIGS. 1*a* and 1*b*, via the pressure line 10 to the stroke-controlled injector 8; a check valve 56 prevents an outflow of the higher fuel pressure via the check valve 55.

Figure 4:
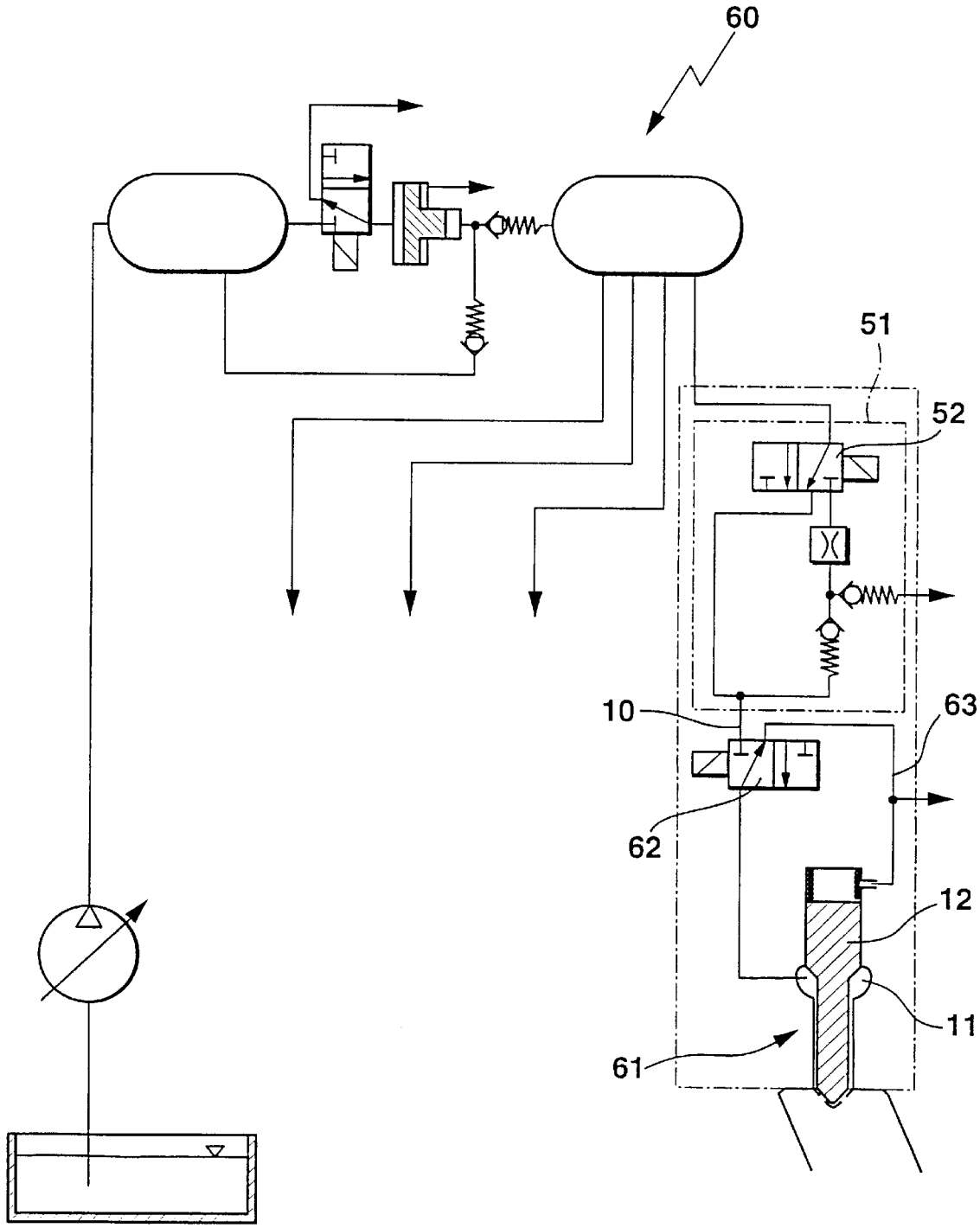
FIG. 4 shows a fourth fuel injection system, corresponding to FIG. 3, but with pressure-controlled injectors.

The injection system 60 (FIG. 4), which otherwise corresponds to the injection system 50, uses pressure-controlled injectors 61, in which the valve member 12 is opened solely by whichever fuel pressure, higher or lower, prevails in the nozzle chamber 11. Whichever fuel pressure prevails downstream of the local diversion unit 51 is switched through by means of a 3/2-way valve 62 disposed in the pressure line 10. A preinjection or postinjection at the lower fuel pressure is effected with electric current supplied to both the 3/2-way valve 52 and the 3/2-way valve 62. If the 3/2-way valve 52 is switched back again in the currentless state, then a switchover can be made to an injection at the higher fuel pressure. At the end of the main injection, either the 3/2-way valve 52 can be resupplied with electric current for a postinjection at the lower fuel pressure, or the 3/2-way valve 62 is switched back for leakage 63. As a result, the pressure line 10 and the nozzle chamber 11 are pressure-relieved, so that the spring-loaded valve member 12 closes the injection openings 14 again.

In a method for injecting fuel at at least two different high fuel pressures via injectors 8; 61 into the combustion chamber of an internal combustion engine, the higher fuel pressure being stored in a central pressure reservoir 6, the lower fuel pressure is generated individually, locally for each injector 8; 61, at all times during the injection event by diversion of the higher fuel pressure, the diversion being activatable or deactivatable via a multi-way valve. To that end, a corresponding fuel injection system 1 with a central pressure reservoir 6 for storing the higher fuel pressure has a local diversion unit 28; 51 for each injector 8; 61 by means of which the lower fuel pressure can be generated dissipatively from the higher fuel pressure, and the local diversion unit 28; 51 has a multi-way valve 9; 52 for activating and deactivating the diversion, respectively. In this way, an improved metering of the lower fuel pressure can be achieved.

The foregoing relates to a preferred exemplary embodiment of the invention, it being understood that other variants and embodiments thereof are possible within the spirit and scope of the invention, the latter being defined by the appended claims.

We claim:

1. A fuel injection system (1; 30; 50; 60) for an internal combustion engine, in which fuel is injected at two different high fuel pressures into a combustion chamber of the internal combustion engine via injectors (8; 61), comprising a central pressure reservoir (6) for storing the higher fuel pressure, for each injector (8; 61), a local diversion unit (28; 51) is provided, by means of which the lower fuel pressure is generated dissipatively from the higher fuel pressure, and the local diversion unit (28; 51) has a multi-way valve (9; 52) for activating and deactivating the diversion, respectively.

2. The fuel injection system according to claim 1, in which the local diversion unit (28; 51) includes a pressure limiting valve (27; 55).

3. The fuel injection system according to claim 2, in which the pressure limiting valve (55) is disposed between the multi-way valve (52) and a nozzle chamber (11) of the injector (8; 61).

4. The fuel injection system according to claim 3, in which a throttle (53) is provided between the multi-way valve (52) and the pressure limiting valve (55).

5. The fuel injection system according to claim 2, in which the pressure limiting valve (27) is disposed on a leakage side downstream of the multi-way valve (9).

6. The fuel injection system according to claim 1, in which upstream of the central pressure reservoir (6) for the higher fuel pressure, at least one further pressure reservoir (61) with a pressure step-up unit downstream of said pressure reservoir (61) is provided.

7. The fuel injection system according to claim 2, in which upstream of the central pressure reservoir (6) for the higher fuel pressure, at least one further pressure reservoir (61) with a pressure step-up unit downstream of said pressure reservoir (61) is provided.

8. The fuel injection system according to claim 3, in which upstream of the central pressure reservoir (6) for the higher fuel pressure, at least one further pressure reservoir (61) with a pressure step-up unit downstream of said pressure reservoir (61) is provided.

9. The fuel injection system according to claim 4, in which upstream of the central pressure reservoir (6) for the higher fuel pressure, at least one further pressure reservoir (61) with a pressure step-up unit downstream of said pressure reservoir (61) is provided.

10. The fuel injection system according to claim 5, in which upstream of the central pressure reservoir (6) for the higher fuel pressure, at least one further pressure reservoir (61) with a pressure step-up unit downstream of said pressure reservoir (61) is provided.

11. The fuel injection system according to claim 6, in which the pressure step-up unit has at least one pressure means (34) with an arrangement for refilling.

12. The fuel injection system according to claim 1, in which the local diversion unit (28; 51) is integrated with the injector (8; 61).

13. The fuel injection system according to claim 2, in which the local diversion unit (28; 51) is integrated with the injector (8; 61).

14. The fuel injection system according to claim 1, in which the local diversion unit is provided in a region of the central pressure reservoir (6) for the higher fuel pressure.

15. The fuel injection system according to claim 1, in which the local diversion unit (28; 51) is disposed at an arbitrary location between the central pressure reservoir (6) for the higher fuel pressure and the nozzle chamber (11) of the injector (8; 61).

16. The fuel injection system according to claim 1, in which the injectors (61) are embodied for a pressure control.

17. The fuel injection system according to claim 2, in which the injectors (61) are embodied for a pressure control.

18. The fuel injection system according to claim 1, in which the injectors (8) are embodied for a stroke control.

19. A method for injecting fuel at at least two different high fuel pressures via an injector (8; 61) into a combustion chamber of an internal combustion engine, the higher fuel pressure being stored in a central pressure reservoir (6), producing a lower fuel pressure individually, locally for the injector (8; 61), at all times during an injection event by diversion of a higher fuel pressure, the diversion being activatable or deactivatable via a multi-way valve.

* * * * *